US011781274B2

(12) United States Patent
Ramaekers

(10) Patent No.: US 11,781,274 B2
(45) Date of Patent: Oct. 10, 2023

(54) ROADBLOCK FOR TEMPORARY INSTALLATION TO BLOCK TRAFFIC AND/OR AS A SECURITY PRECAUTION

(71) Applicant: L Metaal Acquisition, Inc., Toronto (CA)

(72) Inventor: Nicky Joseph Gerardus Ramaekers, Eygelshoven (NL)

( * ) Notice: Subject to any disclaimer, the term of this patent is extended or adjusted under 35 U.S.C. 154(b) by 94 days.

(21) Appl. No.: 17/002,924

(22) Filed: Aug. 26, 2020

(65) Prior Publication Data

US 2021/0062442 A1 Mar. 4, 2021

(30) Foreign Application Priority Data

Aug. 27, 2019 (NL) ..... 2023715

(51) Int. Cl.

| | |
|---|---|
| ***E01F 15/08*** | (2006.01) |
| ***E01F 13/02*** | (2006.01) |
| ***E01F 13/12*** | (2006.01) |
| ***E01F 15/10*** | (2006.01) |
| *E01F 13/04* | (2006.01) |

(52) U.S. Cl.
CPC ..... *E01F 13/022* (2013.01); *E01F 13/12* (2013.01); *E01F 15/08* (2013.01); *E01F 15/10* (2013.01); *E01F 13/044* (2013.01)

(58) Field of Classification Search
CPC ..... E01F 15/08; E01F 15/10; E01F 13/12
See application file for complete search history.

(56) References Cited

U.S. PATENT DOCUMENTS

| | | | | |
|---|---|---|---|---|
| 5,007,763 | A * | 4/1991 | Burgett | E01F 15/006 404/9 |
| 5,387,049 | A * | 2/1995 | Duckett | E01F 15/088 404/6 |
| 5,549,410 | A * | 8/1996 | Beryozkin | E01F 13/12 404/6 |
| 6,666,616 | B2 * | 12/2003 | Yodock, III | E01F 15/083 404/6 |
| 7,600,942 | B2 * | 10/2009 | Yodock, III | E01F 15/086 404/6 |
| 7,775,738 | B2 * | 8/2010 | Darcy | E01F 13/12 404/6 |
| 8,215,866 | B2 * | 7/2012 | Whitford | F41H 5/14 404/9 |

(Continued)

FOREIGN PATENT DOCUMENTS

| | | | |
|---|---|---|---|
| DE | 4219572 | A | 12/1993 |
| DE | 102007027453 | A1 | 12/2008 |

(Continued)

*Primary Examiner* — Gary S Hartmann
(74) *Attorney, Agent, or Firm* — Jack D. Stone, Jr., Esq.; John G. Fischer, Esq.; Scheef & Stone, L.L.C.

(57) ABSTRACT

The present invention relates to a roadblock for temporary installation to block traffic and/or as a security precaution, including: an elongated casing with two opposing longitudinal side walls and an, the two side walls joining, upper wall; and at least one casing support structure located in the elongate casing and connecting to both the side walls; supports for resting on the ground/surface connected to the lower side of the elongate casing and/or the lower side of the casing support structure, and plural stabilisation arms protruding from one of the longitudinal side walls.

14 Claims, 5 Drawing Sheets

(56) References Cited

U.S. PATENT DOCUMENTS

| | | | | |
|---|---|---|---|---|
| 8,925,902 | B2 | 1/2015 | Von Linsingen-Heintzmann et al. | |
| 9,334,614 | B1 * | 5/2016 | Zoellner | E01F 9/669 |
| 10,697,140 | B2 | 6/2020 | Wenger | |
| 11,149,391 | B2 * | 10/2021 | Weissberg | E01F 13/12 |
| 2003/0086761 | A1 * | 5/2003 | Anderson | E01F 13/022 404/6 |
| 2004/0028469 | A1 * | 2/2004 | Dehart | E01F 15/085 404/6 |
| 2008/0286042 | A1 * | 11/2008 | Dyke | E01F 15/006 404/6 |
| 2012/0177439 | A1 * | 7/2012 | More | E01F 13/12 404/6 |
| 2020/0173121 | A1 * | 6/2020 | Klein | E01F 13/12 |
| 2020/0199834 | A1 * | 6/2020 | Stone | E01F 13/12 |

FOREIGN PATENT DOCUMENTS

| | | | | | |
|---|---|---|---|---|---|
| EP | 2730700 | A1 | | 5/2014 | |
| GB | 2178094 | A | * | 2/1987 | E01F 13/12 |
| GB | 2543875 | A | | 5/2017 | |
| JP | 2006132172 | A | * | 5/2006 | |
| WO | 2011047659 | A1 | | 4/2011 | |
| WO | 2017118475 | A1 | | 7/2017 | |
| WO | WO-2019171032 | A1 | * | 9/2019 | E01F 15/08 |

* cited by examiner

ROADBLOCK FOR TEMPORARY INSTALLATION TO BLOCK TRAFFIC AND/OR AS A SECURITY PRECAUTION

CROSS-REFERENCE TO RELATED APPLICATION

This application claims priority to The Netherlands Patent Application No. 2023715 filed Aug. 27, 2019, the disclosure of which is hereby incorporated by reference in its entirety.

BACKGROUND OF THE INVENTION

Field of the Invention

The present invention relates to a roadblock for temporary installation to block traffic and/or as a security precaution comprising an elongated casing with two opposing longitudinal side walls and an, the two side walls joining, upper wall; and at least one casing support structure located in the elongate casing and connecting to both the side walls.

Description of Related Art

Roadblocks are temporary installations set up to control or block traffic, e.g. during roadworks, temporary road closure and as a security precaution, as Hostile Vehicle Mitigation (HVM). The usage demands of such roadblocks are various. Preferably a roadblock is easy to install and remove, as well as easy to transport and store. These demands may for instance be provided by an elongated element substantially shaped as a traffic barrier, which traffic barrier may—or may not—be firmly connected to the ground or surface. A further elementary requirement of a roadblock is that it provides an essential blocking functionality as it has to be able to handle the forces exerted on the roadblock exerted by a vehicle that collides with the roadblock. The blocking functionality may be provided by the combination of various technical features like the shape of the roadblock, the weight (mass) of the roadblock, the connection(s) of the roadblock with the surface and/or one or more roadblock support(s). And even when one or more of the possible mounting assemblies break, disconnect from the roadblock and/or when the mounting assemblies detach from their position due to a considerable force being exerted on the roadblock as a result of the impact of a vehicle onto the roadblock, the roadblock still is required to fulfil a blocking function.

An actual development is that there is an enhanced attention for the blocking functionality of roadblocks as a result of an increased awareness in the protection of public spaces. This increased awareness is, among others, a result of several recent terrorist attacks, wherein vehicles (cars and trucks) were used. The request is thus to further enhance the blocking capabilities of—both existing and new—roadblocks. A problem is thus to provide a roadblock that is easy in use (e.g. easy to install, easy to remove, easy to transport and/or easy to store) in combination with providing a large blocking effect.

SUMMARY OF THE INVENTION

This problem is solved with a roadblock for temporary installation to block traffic and/or as a security precaution, comprising: an elongated casing with two opposing longitudinal side walls and an, the two side walls joining, upper wall; and at least one casing support structure located in the elongate casing and connecting to both the side walls; supports for resting on the ground/surface connected to the lower side of the elongate casing and/or the lower side of the casing support structure, and plural stabilisation arms protruding from one of the longitudinal side walls, wherein the protruding length of the stabilisation arms is adjustable. The lower side of the elongate casing and the lower side of the casing support structure (that are thus located opposite to the upper wall) may be open, partially open or closed. In an operative position the sideward protruding stabilisation arms are preferably brought in a longer (or even better the longest) configuration. In normal practise it is prescribed to use the roadblock only with the stabilisation arms in their longest configuration as that is the condition wherein the roadblock is tested and approved. In the operative (installed) situation of the roadblock the stabilisation arms will rest with their free ends on the bottom or be a short distance from the bottom. When the roadblock then is substantially impacted (e.g. by a vehicle) on the sidewall from which the stabilisation arms protrude the roadblock may start tilting such that the free ends of the stabilisation arms will move upward. With a further forward movement of the vehicle that provides the impact the upward movement of the arms (or at least some of the arms) will contact the underside of the vehicle, and dependent on the forces, dimensions and weights, the vehicle may be partially lifted from the floor. This will normally stop the vehicle and thus the sought for blocking function is provided. For stopping a vehicle with substantial impact the roadblock will thus tilt and the tilted roadblock will have resistance to displacement over the floor/underground while simultaneously the vehicle will be lifted by the rotating stabilisation arms (as a result of the tilting of the roadblock).

For a proper functioning of the roadblock the stabilisation arms will require a substantial length of approximately 0.5-1.5 m. The disadvantage of the protruding arms is however that they are disadvantageous during the handling, transportation and storage of the roadblocks. The present invention however enables to adjust the length of the stabilisation arms so that during the handling, transportation and storage the protruding arms may be reduced in their length or even may be absent. This enables a simpler and cheaper handling, transportation and/or storage of the roadblock according the present invention without any reduction of functionality.

Preferably the stabilisation arms are parallel orientated so that independent of the location of impact the colliding vehicle always will be "caught" by one or more arms. Furthermore the angle enclosed by the stabilisation arms and the longitudinal side wall may be more than 90°, preferably 93°-100°. Such a design further stimulates the "catching" of impacting vehicles.

The stabilisation arms may be located opposite the upper wall of the elongated casing, thus on the lower side of the roadblock. The front of an impacting vehicle first has to pass the protruding ends of the stabilisation arms before the vehicle will contact the upper wall of the elongate casing, this implies that the stabilisation arms will have to be close to the bottom of floor. Furthermore the coupling of the stabilisation arms on the lower side of the roadblock will provide leverage when the arms are moved upward during the tilting of the roadblock.

There are several alternatives for the adjustment of the protruding length of the stabilisation arms. The stabilisation arms may be formed by at least two interchangeable arm segments, for instance telescopically segmented arms.

Another option is that interchangeable arms are completely detachable or that a segmented arm has one or more detachable segments.

The supports may be provided with at least one central protrusion facing away from the elongated casing, which central protrusions are located on the side of a vertical central plane though the elongated casing that is facing away from the longitudinal side wall with the stabilisation arms. These central protrusions are forming the first pivot points during the initial tilting of the roadblock.

The supports may also be provided with at least one second sideward protrusion facing away from the elongated casing, which sideward protrusions are located alongside the elongated casing on the side facing away from the stabilisation arms. These second sideward protrusions are forming the second pivot points during further tiling of the roadblock after the initial tilting took place over the central protrusions of the supports and as described in the previous paragraph. To facilitate this change of pivot point during the tilting from the central protrusions to the second sideward protrusions the central protrusions may protrude further down than the sideward protrusions.

The central protrusions and/or the sideward protrusions may have sharp angles to prevent the roadblock to shift over the floor after impact. Sharp angled protrusions may grip into the bottom and increase the frictional resistance between the roadblock and the bottom.

The sideward protrusions may also have at least two sharp angles, like some teeth of a gear, so that during further tilting of the barrier the point of pivoting may be followed from one to the next sharp angle.

As the blocking functionality of the roadblock on the sides is relevant the ends of the elongated casing may be chamfered. This also prevents the chance of unwanted contact of road users (pedestrians, cyclists, guards) with the roadblock.

To enable coupling of the roadblock with other roadblocks or other objects the ends of the elongated casing may be provided with couplings.

The roadblock may also be provided with a least one friction-increasing element attached to the upper wall of the elongated casing such that at least one (tapered) contact edge is protruding from a longitudinal side wall of the elongated casing. The advantage of the add on of a friction-increasing element is that when the roadblock to which the friction-increasing element is attached tilts, or is toppled, the tapered contact edge of the friction-increasing element may contact the ground (or surface) the roadblock stood on until the moment of impact. Due to the contact of the (tapered) contact edge the friction between the frictional resistance between the road barrier and the ground increases due to which the further displacement (shift) of the barrier over the ground is further inhibited or prevented. The cause of this is the local high pressure on the location(s) where the contact edge engages on the ground/floor. The contact edge, e.g. a toothed edge, may "bite" into the ground.

In the roadblock also height adjustable wheels may be provided. Such wheels may be used for relocation of the roadblock over shorter distances like for instance during accurate positioning of the roadblock. During use of the roadblock the wheels have to be lifted to prevent undesired movement of the roadblock with the wheels.

The roadblock may mainly made from steel as in practice steel sheet material is easy to obtain at reasonable prices. Also during the production of prior art traffic barriers and roadblocks often use is made of steel plate material so the production the roadblock according the present invention will normally fit the production facilities of traffic barrier and roadblock producers without the demand for substantive changes of adaptation.

The roadblock according the present invention may also be provided with at least one, but preferably at least two, lifting openings to enable to attach a manipulator (e.g. a crane) for instalment and/or removal of the roadblock.

BRIEF DESCRIPTION OF THE DRAWINGS

The present invention will be further elucidated on the basis of the non-limitative exemplary embodiments shown in the following figures, herein shows.

DESCRIPTION OF THE INVENTION

Figure 1:
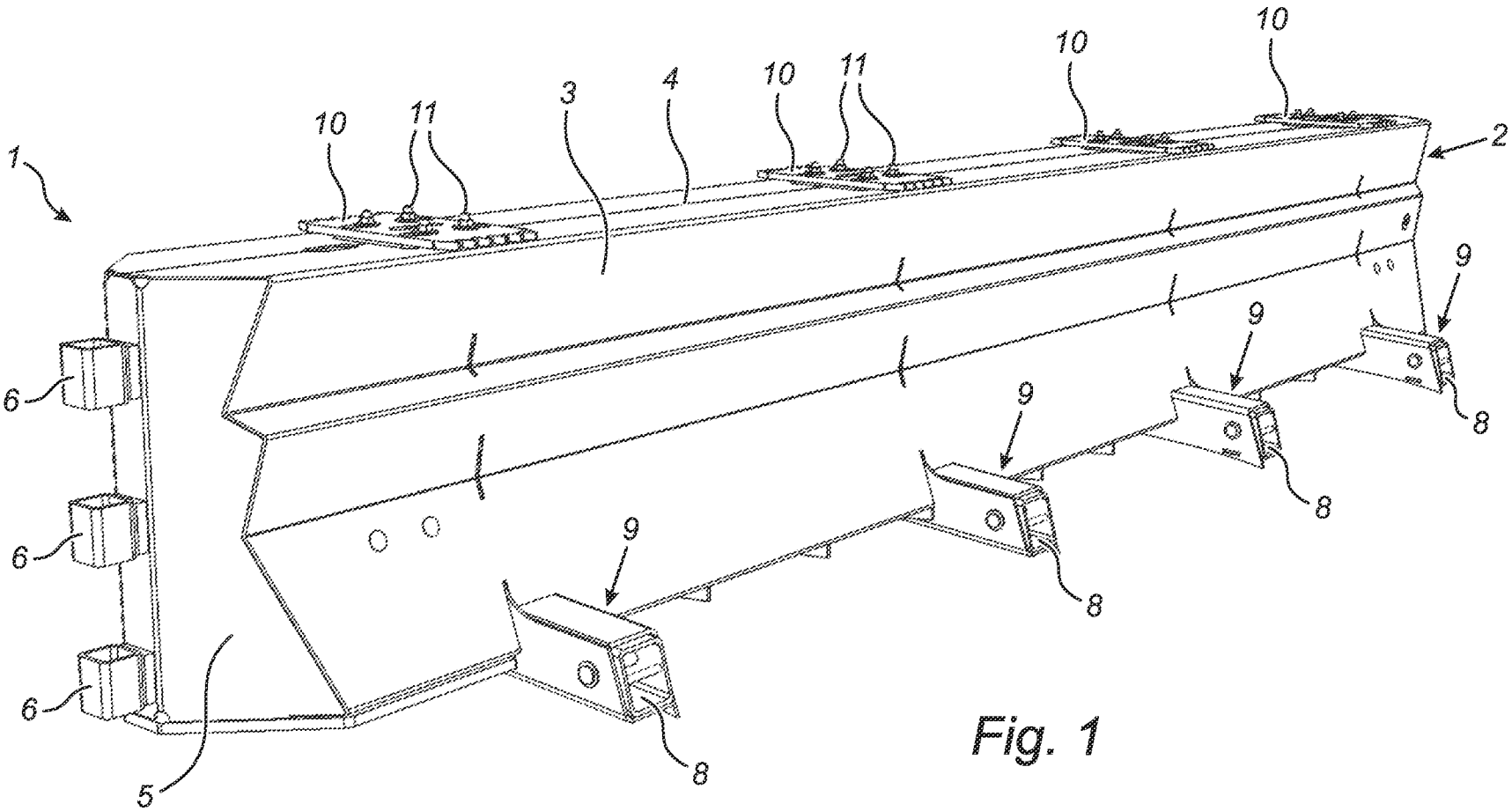
FIG. 1 a perspective view of a roadblock according the present invention with limited length of the stabilisation arms.

FIG. 1 shows a roadblock 1 with an elongate casing 2 with a longitudinal side wall 3, an upper wall 4 and a chamfered end part 5 with couplings 6. A casing support structure is located in the elongate casing 2. On the lower side of the roadblock 1 supports 8 are attached for resting on the ground/surface and four stabilisation arms 9 protrude from the longitudinal side wall 3. On the upper wall 4 are friction-increasing elements 10 attached with fixing bolts 11. In the state represented in this FIG. 1 the stabilisation arms 9 are collapsed and have only a limited length enabling a relative simple handling, transportation and storage of the roadblock 1.

Figure 2:
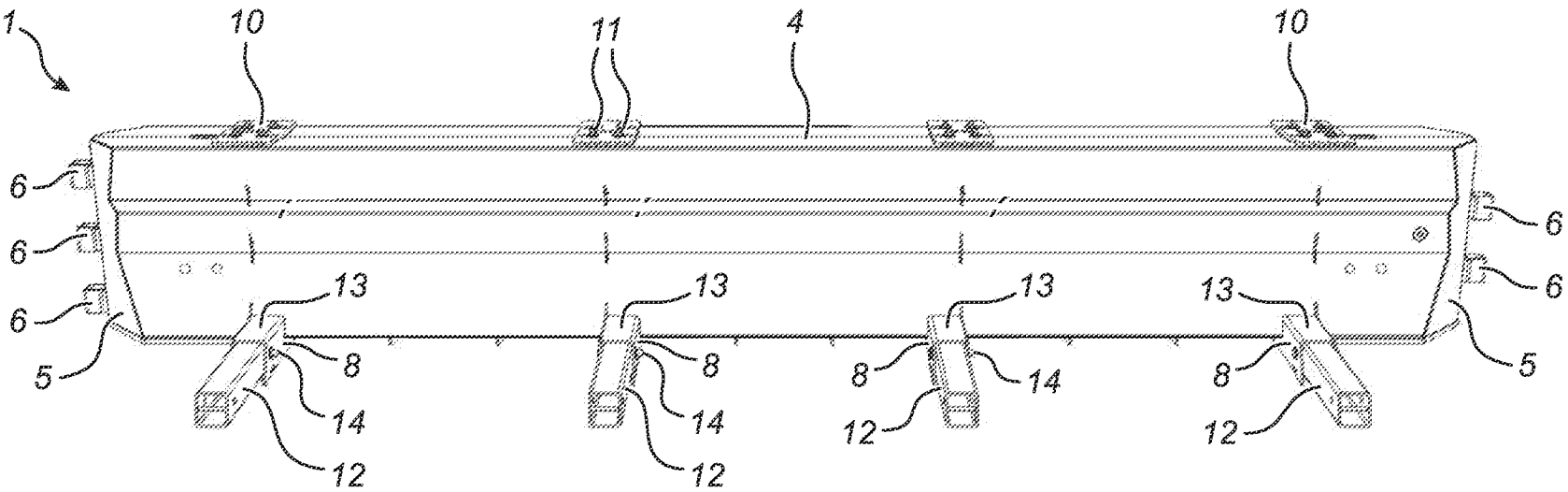
FIG. 2 a perspective frontal view of the roadblock shown in FIG. 1 with longer stabilisation arms than the state shown in FIG. 1.

FIG. 2 shows the roadblock 1 shown in FIG. 1 with longer stabilisation arms 9 than the state shown in FIG. 1. Here the stabilisation arms 9 are extended; telescopic sliding inner arm segments 12 are moved out of larger outer arm segments 13. The extended position of the inner arm parts 12 is secured by locking pins 14.

Figure 3A:
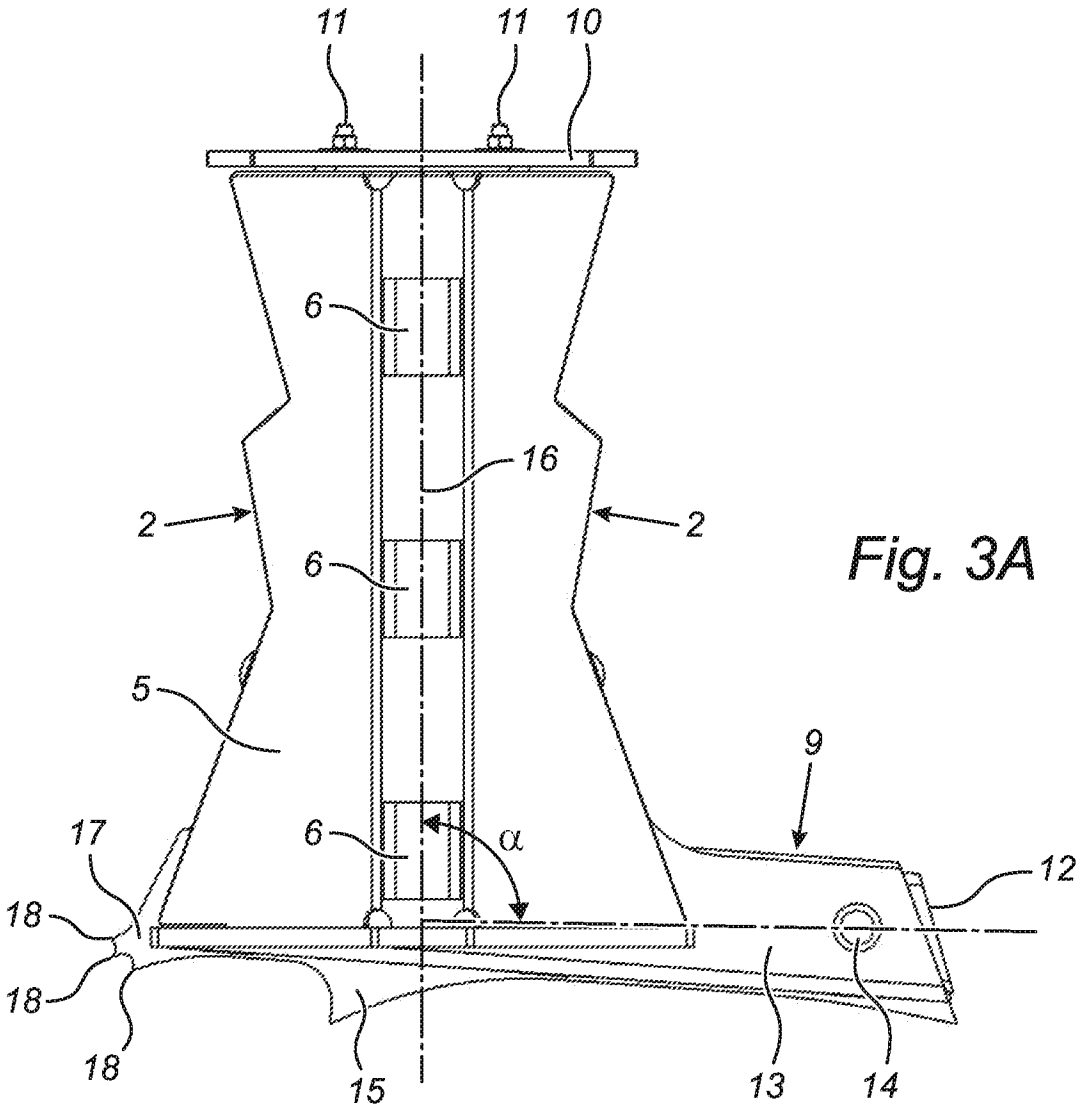
FIG. 3A a side view of the roadblock in the state shown in FIG. 1.
Figure 3B:
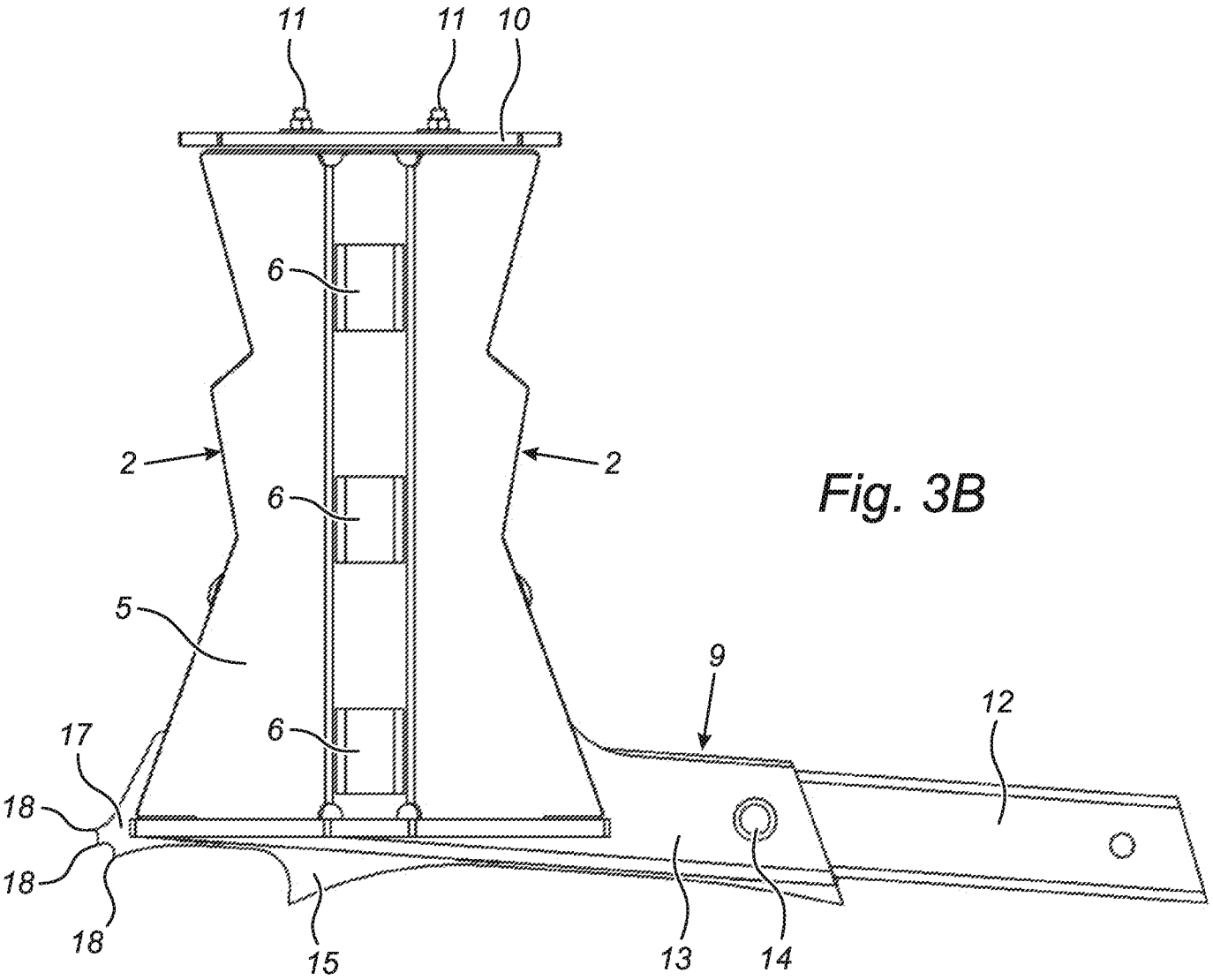
FIG. 3B a side view of the roadblock in the state shown in FIG. 2.

FIG. 3A a side view of the roadblock 1 in the state shown in FIG. 1, thus with collapsed stabilisation arms 9. Also visible is that the locking pin 14 secures the "stowed away" inner arm segment 12 in the outer arm segment 13. In this figure also a better view is provided on a support 8. The support 8 has a sharp angled central protrusion 15 facing downward and the protrusion 15 is located on the side of a (fictional) vertical central plane 16 though the roadblock 1 opposite the side of the roadblock 1 with the stabilisation arms 9. The support 8 further also has a second sideward protrusion 17 also facing down and this second sideward protrusion 17 is located alongside the elongated casing 2 on the side facing away from the stabilisation arms 9. The second sideward protrusion 17 has three sharp angles 18. Also clearly visible is that the central protrusion 15 protrudes further down than the sideward protrusion 17. In FIG. 3B the side view of the roadblock 1 according FIG. 3A is shown again but here, like in FIG. 2, the inner arm segment 12 is moved out of larger outer arm segment 13 thus the stabilisation arm 9 is now in a longer state. The angle $\alpha$ enclosed by the stabilisation arm 9 and the vertical central plane 16 (or the longitudinal side wall 3) is more than 90°.

Figure 4:
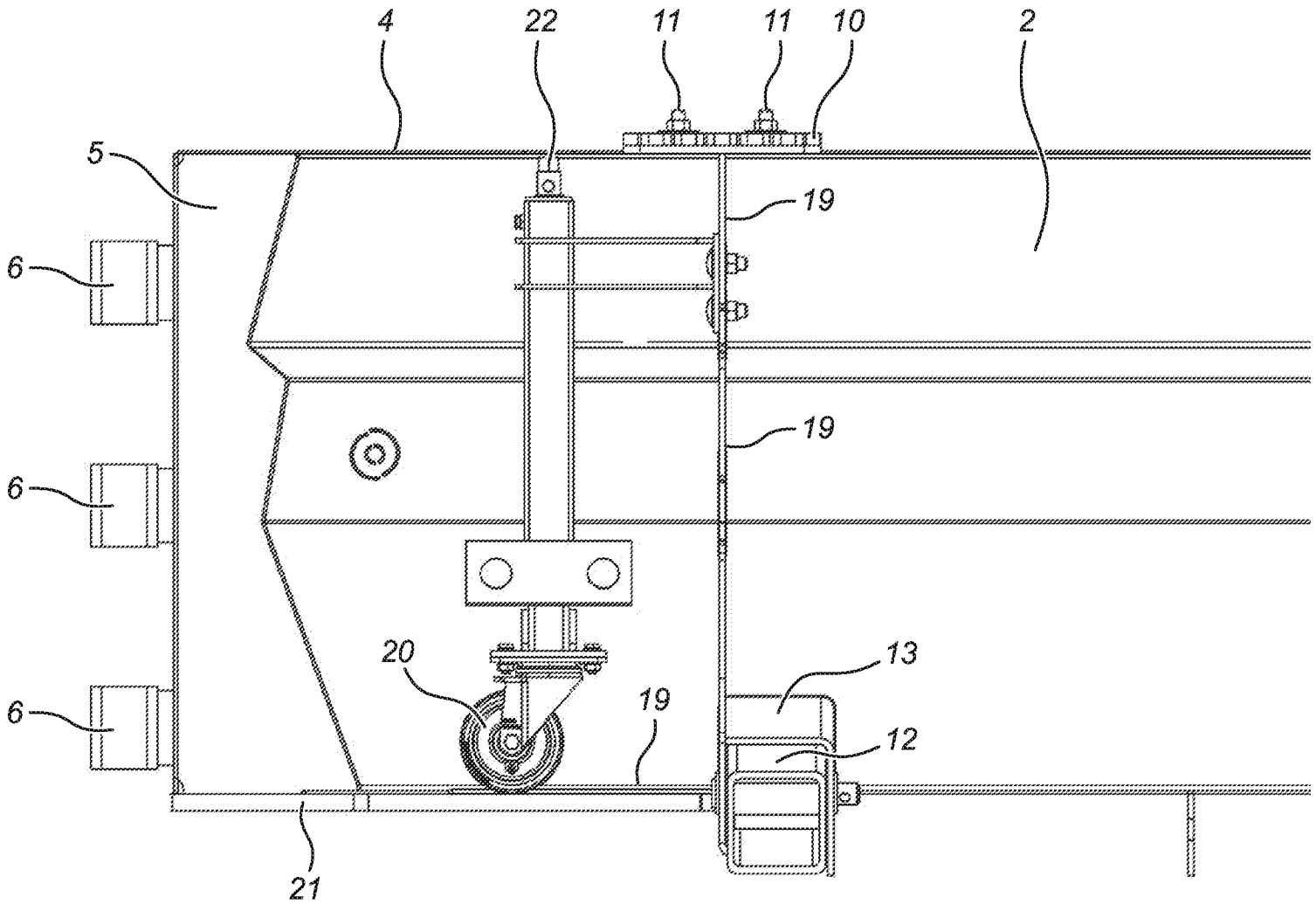
FIG. 4 a cut-away side view of a part of the roadblock shown in the previous figure showing a part of the interior.

FIG. 4 shows a cut-away part of the roadblock 1 with a part of the interior of the roadblock. A part of a casing support structure 19, which is located in the elongate casing 2, holds a wheel 20 of which the position is adjustable so that the wheel 20 may be lowered so far that it protrudes to below the lower side 21 of the roadblock 1. For adjustment of the position of the wheel 20 a bolt coupling 22 is accessible through the upper wall 4.

The invention claimed is:

1. A roadblock for temporary installation to block traffic and/or as a security precaution, comprising:

an elongated casing with two opposing longitudinal side walls, the two side walls joining an upper wall;

at least one casing support structure located in the elongate casing;

at least one wheel held by the at least one casing support structure, wherein the position of the wheel is adjustable;

supports for resting on the ground/surface connected to the lower side of the elongate casing and/or the lower side of the casing support structure; and plural stabilization arms protruding from one of the longitudinal side walls, each of which stabilization arms includes a telescopic sliding inner arm segment movable out of a larger outer arm segment;

wherein the protruding length of each of the stabilization arms is adjustable by telescopically sliding a respective inner arm segment out of a respective larger outer arm segment.

2. The roadblock according to claim 1, characterized in that the stabilization arms are parallel orientated.

3. The roadblock according to claim 1, characterized in that the angle enclosed by the stabilization arms and the longitudinal side wall is more than 90°, preferably 93°-100°.

4. The roadblock according to claim 1, characterized in that stabilization arms are located opposite the upper wall of the elongated casing.

5. The roadblock according to claim 1, characterized in that at least one of the inner arm segment and the outer arm segment is detachable.

6. The roadblock according to claim 1, characterized in that the supports are provided with at least one central protrusion facing away from the elongated casing, which central protrusion is located on the side of a vertical central plane through the elongated casing that is facing away from the longitudinal side wall with the stabilization arms.

7. The roadblock according to claim 6, characterized in that the supports are provided with at least one second sideward protrusion facing away from the elongated casing, which sideward protrusion is located alongside the elongated casing on the side facing away from the stabilization arms.

8. The roadblock according to claim 7, characterized in that the central protrusion protrudes further down than the sideward protrusion.

9. The roadblock according to claim 6, characterized in that the central protrusion and/or the sideward protrusion has sharp angles.

10. The roadblock according to claim 7, characterized in that the sideward protrusion has at least two sharp angles.

11. The roadblock according to claim 1, characterized in that the ends of the elongated casing are chamfered.

12. The roadblock according to claim 1, characterized in that ends of the elongated casing are provided with couplings.

13. The roadblock according to claim 1, characterized in that the roadblock is provided with at least one friction-increasing element attached to the upper wall of the elongated casing such that at least one contact edge of the friction-increasing element is protruding from a longitudinal side wall of the elongated casing.

14. A roadblock for temporary installation to block traffic and/or as a security precaution, comprising:

an elongated casing with two opposing longitudinal side walls, the two side walls joining an upper wall;

at least one casing support structure located in the elongate casing;

supports for resting on the ground/surface connected to the lower side of the elongate casing and/or the lower side of the casing support structure; and plural stabilization arms protruding from one of the longitudinal side walls, each of which stabilization arms includes a telescopic sliding inner arm segment movable out of a larger outer arm segment;

wherein the protruding length of each of the stabilization arms is adjustable by telescopically sliding a respective inner arm segment out of a respective larger outer arm segment.

* * * * *